United States Patent [19]

Komagata

[11] 4,380,885

[45] Apr. 26, 1983

[54] HOOP TOY

[75] Inventor: Tadashi Komagata, Tokyo, Japan

[73] Assignee: Tsukuda Co., Ltd., Tokyo, Japan

[21] Appl. No.: 223,929

[22] Filed: Jan. 9, 1981

[30] Foreign Application Priority Data

Aug. 18, 1980 [JP] Japan ..... 55-115962[U]

[51] Int. Cl.[3] ..... A63H 33/02; A63H 1/32; B25G 3/00

[52] U.S. Cl. ..... 46/220; 46/47; 403/383; 273/425

[58] Field of Search ..... 46/47, 220, 281, 29; 403/292, 383; 273/425

[56] References Cited

U.S. PATENT DOCUMENTS

| | | | |
|---|---|---|---|
| 1,955,330 | 4/1934 | Hiers et al. | 46/220 |
| 3,102,742 | 9/1963 | Shureliff | 46/28 |
| 3,254,443 | 6/1966 | Olson | 46/220 |
| 3,332,166 | 7/1967 | Alexander | 46/220 |
| 3,729,860 | 5/1973 | Kargul | 46/47 |
| 3,894,173 | 7/1975 | Andrews | 40/316 |
| 3,935,668 | 2/1976 | Phillips, Jr. | 46/220 |
| 4,020,566 | 5/1977 | Drieding | 46/28 |

*Primary Examiner*—Gene Mancene
*Assistant Examiner*—Michael J. Foycik
*Attorney, Agent, or Firm*—Cantor and Lessler

[57] ABSTRACT

A hoop toy related to the well-known "Hula Hoop" is constructed in the form of detachable arc segments, different numbers of which can be used by the player in fastening the entire hoop, allowing the hoop toy to be adjustable as to diameter, and further allowing complete disassembly for ease and convenience in storage and transportation. The fastening by which said arc segments are joined provide integrity and rigidity for the hoop and maintain the orientation of the entire hoop in a single geometric plane.

1 Claim, 3 Drawing Figures

HOOP TOY

BACKGROUND OF THE INVENTION

The present invention relates to improvements in a well-known "Hula Hoop" toy, and more particularly, to a toy of the type which essentially comprises a large, lightweight hoop of plastic or similar material, which, in use, is placed over the body, for example, at waist level, and which is maintained rotating and suspended above the ground by the hip-swinging movements of the player.

The original version of this type toy consisted of a single tubular material formed into the shape of a circle (or hoop), either manufactured in seamless form, or with the circle being formed by bending the manufactured tubing and fastening the two ends together by any of a number of conventional means. Since then, a variety of decorative embellishments have been added. In all cases, however, the hoop-shape, once achieved, was permanent. This was in keeping with the extremely simple nature of the toy.

However, this very simplicity caused the hoop itself to remain somewhat unwieldy when not in use, oversized and difficult to store and transport. It is also the case with conventional toys of this type that, while they are available in different diameters, no single hoop is adjustable to other than its original size.

SUMMARY OF THE INVENTION

It is therefore an object of the present invention to provide a hoop toy of the type described, but which has the advantages of being capable of disassembly for storage or transportation, and being adjustable as desired by the player to a variety of diameters.

This object is achieved in the present invention by manufacturing the hoop toy in a plurality of arc-shaped segments easily connectable in series, whereby the fastening of the entire circle is possible. Fastening is by means of male-female, or projection-receptacle locking devices, as will be explained in detail below. Guide grooves and corresponding guide ridges are provided which insure that the plurality of arc segments lie in the same geometric plane, and, within limits, various numbers of arc segments can be utilized at the discretion of the player, making it possible to vary the diameter of the hoop toy.

DETAILED DESCRIPTION OF THE PREFERRED EMBODIMENT

Figure 1:
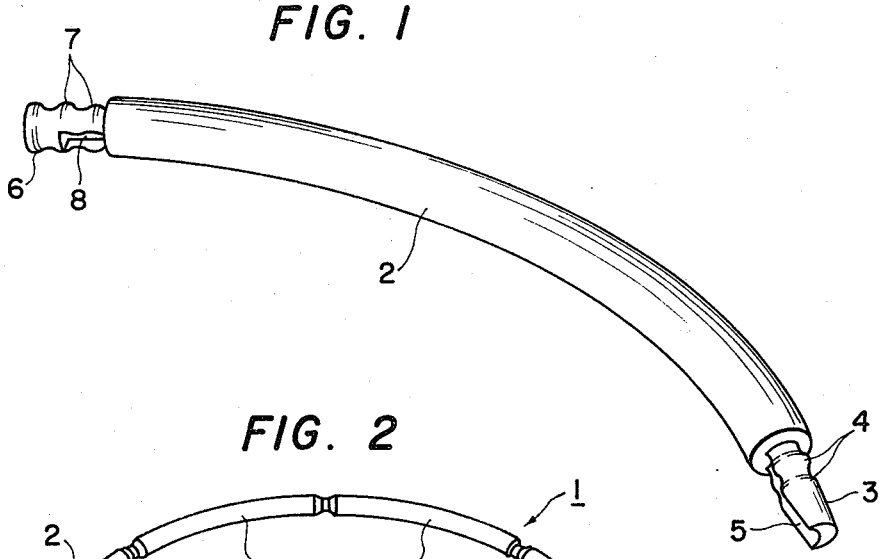
FIG. 1 shows a perspective view of one arc segment of one embodiment of a hoop toy according to the present invention, wherein the projection and hollow tubular member or parts of the fastening means can be seen.
Figure 2:
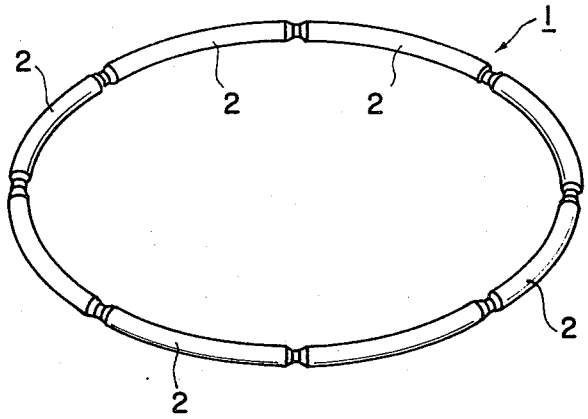
FIG. 2 shows a perspective view of one embodiment of a complete hoop toy according to the present invention.

Referring to FIGS. 1 and 2, there is shown a hoop toy 1 comprising eight arc segments 2. At one end of each arc segment 2 there is formed a projection 3, comprising a plurality of ribs 4 provided in the circumferential direction around the projection 3, and a guide groove 5 provided in the longitudinal direction along the projection 3. At the other end of each arc segment there is formed a hollow tubular member or receptable 6 for fixedly receiving therein a corresponding projection 3 comprising a plurality of ribs provided in the circumferential direction around the receptacle 6, and a guide ridge 8 provided in the longitudinal direction along the receptacle 6. The projections 3 of all arc segments 2 are identical, and the receptacles 6 of all arc segments 2 are identical. In the case of both the projections 3 and the receptacles 6, the maximum diameters thereof are at their plurality of respective ribs 4 and 7, but said ribs do not extend outward beyond the maximum diameter of the cylindrical portions of the arc segment 2.

Figure 3:
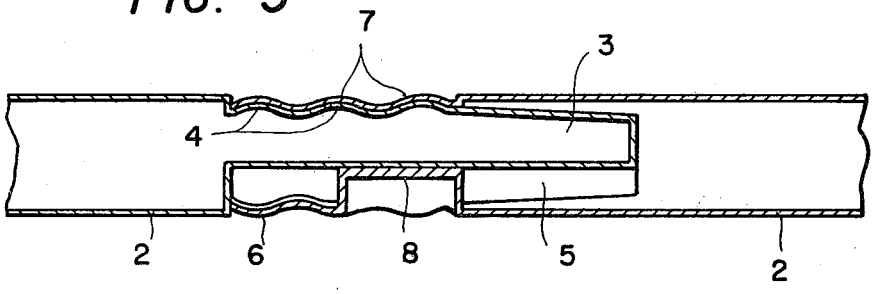
FIG. 3 shows a cross-sectional view of one embodiment of the arc-segment fastening means for the present invention, wherein the projection and receptable portions thereof are in an engagement state.

Referring to FIG. 3, the projections 3 and receptacles 6 are constructed to retain a certain amount of flexibility and elasticity, although they are essentially rigid. The dimensions of the projections 3 and the dimensions of the receptacles 6, particularly at their respective ribs 4 and 7, are such that insertion of a projection 3 into a receptacle 6 results in a tight fit between the exterior surface of the projection 3 and the interior surface of the receptacle 6, as shown in the figure.

It will be easily understood that such insertion requires a certain amount of distortion of both the projection 3 and the receptacle 6, since the greatest diameter of the former must pass through the smallest diameter of the latter. This is possible by virtue of the aforementioned flexibility of both said parts. Thereafter, the elasticity of the same parts, allowing them to return to their original shapes, provides the "locking" element, since forcible distortion would again be required to separate the parts.

Moreover, longitudinally along the inside surface of each receptacle 6, a guide ridge 8 is formed. At the corresponding outside portion of each projection 3, a guide groove 5 is formed. The guide groove 5 and guide ridge 8 serve to limit attachment of the arc segments to a single orientation, thus ensuring that the form of the hoop ultimately fastened will remain fixed in one geometric plane, and further serve to increase the rigidity of the entire hoop toy 1.

As depicted in FIG. 2 and discussed above, a complete circular hoop toy 1 comprises eight arc segments 2. However, a certain looseness in the above-described arrangement makes it possible for the player to construct a hoop of more or less of the same segments 2. Strictly speaking, of course, a true circle can only be formed from a given number of arc segments, that number being determined by the size and curvature of each arc segment 2. However, for practical purposes, a totally functional hoop toy 1 can be assemble from a different number of arc segments 2, limited essentially by what the player deems to be acceptable.

In addition to this adjustability, the hoop toy 1 can be completely disassembled into its arc-segment 2 components, by simply "pulling it part," thus greatly adding to the convenience of it for storage and transportation.

In the foregoing embodiment, the arc segments 2 can be either solid or tubularly hollow, as long as they are of the necessary strength and weight.

Nor need the exterior surfaces of the projections 3 exactly match the interior surfaces of the receptacles 6, as they are shown to do in FIG. 3. It is only necessary that the concept of a larger diameter passing through a smaller diameter, thereby providing a "locking" element, be present.

What is claimed is:

1. A hoop toy which is easily disassemblable comprising a plurality of members in the form of arc segments and integral fastening means for removably connecting said members to each other; said fastening means comprising a projection integrally formed in one end of each member and a socket integrally formed in the other end of each member, said projections and sockets being flexible and elastic such that a larger diameter portion of the projection can, with momentary distortion of either or both of the projection and socket, be forcibly inserted through a smaller diameter portion of the socket, with said projection and socket thereafter returning to their original shapes; said socket being corrugated to form a plurality of circumferential ribs along its entire length and having an inwardly directed guide ridge extending longitudinally outwardly from the end of said socket proximal to said member along only a part of the length of said socket; said projection being corrugated from the end proximal to said member to form a plurality of circumferential ribs along a part of its length corresponding to the length of said socket and thereafter being tapered to its distal end, and having a guide groove along its entire length adapted to cooperate with said guide ridge; and wherein the interior surface portion of said socket and the exterior surface portion of said projection corresponding thereto closely conform as to dimensions and shape.

* * * * *